United States Patent [19]

Tscheppe

[11] 4,361,418

[45] Nov. 30, 1982

[54] HIGH VACUUM PROCESSING SYSTEM HAVING IMPROVED RECYCLE DRAW-DOWN CAPABILITY UNDER HIGH HUMIDITY AMBIENT ATMOSPHERIC CONDITIONS

[75] Inventor: Andrew Tscheppe, Watertown, Conn.

[73] Assignee: Risdon Corporation, Naugatuck, Conn.

[21] Appl. No.: 147,205

[22] Filed: May 6, 1980

[51] Int. Cl.[3] ..... F04F 9/04

[52] U.S. Cl. ..... 417/54; 62/55.5; 118/50; 118/500; 118/715; 417/152; 417/244

[58] Field of Search ..... 417/152–154, 417/53, 54, 51, 55, 244; 62/55.5, 270; 118/50, 715, 500; 427/248.1, 294

[56] References Cited

U.S. PATENT DOCUMENTS

| | | | |
|---|---|---|---|
| 2,806,644 | 9/1957 | Warren | 417/154 |
| 3,095,494 | 6/1963 | Denton et al. | 118/715 X |
| 3,278,113 | 10/1966 | Landfors | 417/154 |
| 3,485,054 | 12/1969 | Hogan | 62/55.5 |
| 3,801,225 | 4/1974 | Power | 417/154 X |
| 4,214,853 | 7/1980 | Mahl | 417/154 |

*Primary Examiner*—Carlton R. Croyle
*Assistant Examiner*—Edward Look
*Attorney, Agent, or Firm*—St. Onge, Steward, Johnston & Reens

[57] ABSTRACT

Water contamination of the oil in vacuum pumps of high vacuum systems is a major problem in maintaining efficient operation of those pumps. The problem is especially acute where a system includes an evacuated work chamber that must be repeatedly opened for loading products into and unloading them from that chamber where the ambient atmosphere has high humidity. The invention involves utilizing first stage mechanical vacuum pump means in conjunction with final stage high vacuum diffusion pump means, and a cryocoil with fast defrost capability located in the vacuum duct leading from the work chamber to the pumps, in combination with an auxiliary low capacity vacuum pump and a flip/flop valving arrangement which connects the discharge side of the diffusion pump selectively to the first stage mechanical pump or to the auxiliary pump. The flip/flop valving arrangement allows the auxiliary pump to maintain moderate vacuum condition in the diffusion pump during idling periods and also serves as a continuous scavenger of water vapor present in the system, particularly during cycles of defrosting the cryocoil. The invention insures that any water vapor in the system not exhausted by the main pumps to ambient atmosphere or trapped as frost by the cryocoil, is prevented from accumulating in and emulsifying with the oil of the main vacuum pumps. By means of the invention system, any residual water is collected in the sump of the auxiliary pump and is prevented through the provision of the flip/flop valving arrangement from revaporizing and backstreaming through the main pumps during their pump-down cycle. Periodic replacement of the low cost auxiliary pump oil removes the residual water trapped in that pump.

9 Claims, 3 Drawing Figures

HIGH VACUUM PROCESSING SYSTEM HAVING IMPROVED RECYCLE DRAW-DOWN CAPABILITY UNDER HIGH HUMIDITY AMBIENT ATMOSPHERIC CONDITIONS

BACKGROUND OF THE INVENTION

1. Field of the Invention

This invention relates to apparatus and method for high vacuum pump systems, and particularly to those wherein a chamber evacuated by the pump must be repeatedly vented to an atmosphere that contains substantial water vapor. Deterioration of the efficiency of the vacuum pump operation, due to contamination of the pump oil by accumulation of condensed water vapor, is prevented by the invention herein disclosed.

2. Description of the Prior Art

In commercial metallization or coating operations, the problem of water accumulation in the oil of mechanical vacuum pumps, and particularly in second or final stage high vacuum diffusion vacuum pumps, and consequent loss of pumping efficiency, has been a recognized problem for years. The high cost of special pump oils employed for lubrication and operation of high vacuum pumps makes it economically prohibitive to replace that oil frequently in order to maintain maximum pumping efficiency. This is more especially true in the case of silicone oil used in the diffusion pumps, which is extremely costly. The recycle rate of processing workpieces in a vacuum metallizing chamber suffers with deterioration of the vacuum pumping efficiency, often being reduced under high humidity atmospheric conditions to one-half to one-tenth that of which the system is capable when operating at maximum efficiency.

One of the solutions to the problem proposed by the prior art has been the incorporation of cryopumps in conjunction with a diffusion pump and/or mechanical forepumps in order to extract vapor present in the vacuum duct as frost on the cryo surface. For example, very low temperature liquid nitrogen or helium coldtraps which may be of optical dense design such as chevron baffle form to increase their trapping ability, or cryocoils such as Meissner coils, have been used for this purpose. The operating costs of these systems are relatively high and the commercial success has been variable. The problem still remains of what to do with the frost on the cold trap when it builds up to a point where the trap is no longer effective. These problems are especially acute with systems using liquid nitrogen as refrigerant which introduces special disadvantages in terms of refrigerant handling problems, maintenance work, personnel safety risks, as well as the high costs. Alternate cascade refrigerant systems of the Freon/ethylene type have also been employed, and while these eliminate the high risk to operating personnel of the liquified nitrogen systems, still they have not solved the water contamination problem spoken of above because the accumulated frost must still be eliminated periodically and contamination of the pumps in the process remains.

U.S. Pat. Nos. 3,168,819, 3,485,054, 3,512,369, 3,536,418, 3,712,074 and 4,148,196 all disclose cryopumps in conjunction with a diffusion pump, and represent the most pertinent prior patent art of which the inventor is aware. Of these, U.S. Pat. No. 3,485,054 is probably most relevant to this invention but does not suggest the solution disclosed herein. The patent art alternately suggests other approaches to handling some of the problems mentioned above, for example special mechanical improvements in vacuum chamber sealing arrangements, as disclosed in U.S. Pat. No. 3,095,494; or product mounting arrangements in the vacuum chamber, as disclosed in U.S. Pat. No. 4,191,128. On the specific subject of improving the production rate under high humidity conditions of vacuum metallizing operations, the most pertinent disclosure known to the inventor is contained in a technical paper dated December 1977 distributed by Polycold Systems, Inc. of San Rafael, Calif. entitled "Improving Summer Pumpdowns in Vacuum Coating Systems". This describes several systems incorporating combinations of cryopumps assisting diffusion and mechanical pump systems, and provides a discussion of specific problems encountered in vacuum metallizing operations. The disclosure includes reference to "hot gas" defrost of a Meissner coil made practical by a cascade refrigeration system. The publication reports that practical and economic improvements are achieved in combining a cryopump with a diffusion pump but so far as is known, this publication has still not led to a satisfactory solution of the problems of water contamination of the pump oil and resultant decrease in operating efficiency.

SUMMARY OF THE INVENTION

The embodiment of the invention hereinafter described and illustrated relates specifically to vacuum metallizing apparatus for coating articles with decorative or functional deposits of metals, such as aluminum. The principles however are applicable to other vacuum pumping systems especially where the water vapor contamination problem is encountered. In the case of vacuum metallizing operations, the apparatus employed includes a large coating chamber which must be repeatedly opened to atmosphere to introduce the articles to be coated, then closed and evacuated to very low pressure while the coating operation takes place, and finally opened again to remove the articles after they have been coated. The cycle is repeated for each batch of products coated by the apparatus. For producing the very high vacuum condition (e.g. 0.5 microatmosphere) necessary to successfully carry out this operation, conventional multistage mechanical vacuum and booster pumps are connected in series to provide a first stage or "roughing down" vacuum pumping operation. Appropriate roughing and foreline valve controls allow the first stage to be switched from direct communication with the vacuum chamber to series connection with an ultra-high vacuum diffusion pump, in which later condition of operation the first stage acts as a back-up to the diffusion pump in producing the final vacuum level required for the metallizing operation. A cryopump or cryocoil is also located in the vacuum duct system between the diffusion pump and a main vacuum shut-off valve connected to the work chamber. The main vacuum valve is operable to isolate the chamber from the diffusion pump whenever the chamber is opened for loading and unloading of workpieces, and at other times such as during defrosting of the cryocoil. The foreline shutoff valve is incorporated between the mechanical pumps and the diffusion pump, and is in parallel connection with the roughing valve. In addition, a small auxiliary mechanical vacuum pump of relatively low capacity has its vacuum side connected between the foreline valve and diffusion pump. So much of the system just described in fairly standard, but the invention modifies this by incorporating an auxiliary shut-off valve between the auxiliary and diffusion pumps, and control means is provided for interconnecting the auxiliary and foreline shut-off valves so that when one is open, the other is closed. The operation of this flip/flop valve arrangement and its significance to the invention will be further described below.

Operating controls are provided for effecting a rapid cryocoil defrost cycle of operation by introducing into the coil hot uncondensed refrigerant gas from the compressor of the cascade refrigeration system. A very rapid removal of frost accumulation on the coil can thus be accomplished. Under defrost conditions, the main vacuum shut-off valve between the work chamber and the diffusion pump is closed, while the auxiliary shut-off valve is open and the foreline valve is closed. Accumulated frost on the cryocoil sublimes in part and is exhausted as steam to atmosphere by the auxiliary vacuum pump. Solid frost (ice) particles and liquid water may also fall off the cryocoil into the oil sump of the diffusion pump during this process; but since the diffusion pump oil is continuously heated to over 400° F., such defrost ice or water is quickly evaporated and exhausted to atmosphere by the auxiliary pump. The arrangement prevents any accumulated water from remaining in extended contact with the pump oil, thereby avoiding emulsification and deterioration of the pumping efficiency of the oil.

It is accordingly an object of the invention to provide a practical and economical high vacuum system which is essentially free of the problems heretofore encountered in respect of contamination of the pump oil so that system can be maintained at optimum operating conditions for long periods without interruption for removal and replacement of contaminated pump oil. It is a further purpose to eliminate dependence on super-cold cryo systems employing liquid helium, nitrogen, etc. as the refrigerant, whereby to avoid high cost and personnel risk attendant upon those systems.

Other objects, aspects and advantages of the present invention will be set forth in or be understood from the following detailed description taken in conjunction with the accompanying drawings.

DETAILED DESCRIPTION OF THE PREFERRED EMBODIMENTS

Figure 2:
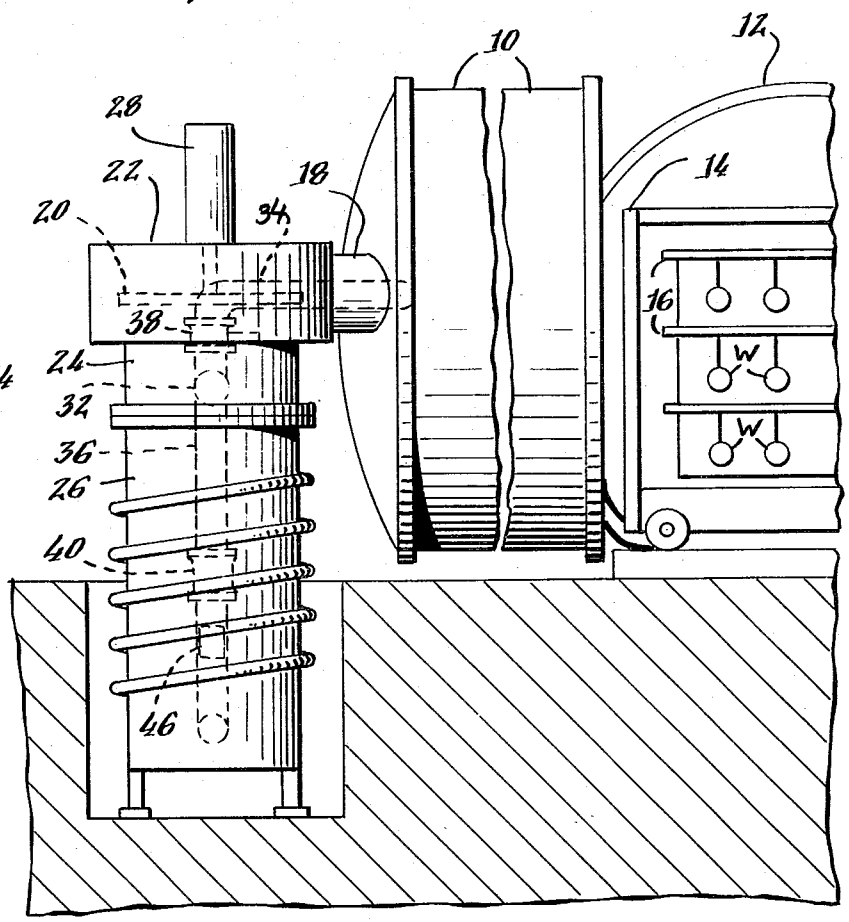
FIGS. 1 and 2 are end and side elevational views, respectively, of a typical vacuum metallizing installation, incorporating a mechanical forepump and booster operating in conjunction with a high vacuum diffusion pump connected to a work chamber.
Figure 1:
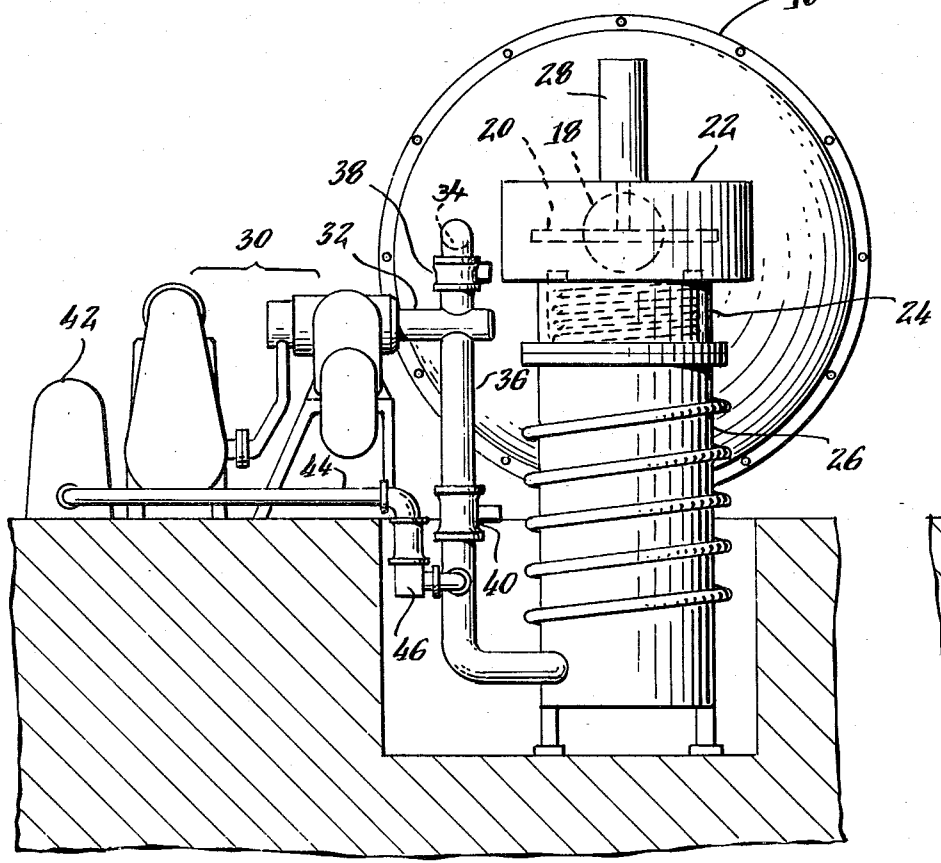

With reference to FIGS. 1 and 2 of the drawings, a large vacuum metallizing chamber 10 is provided with a hinged access door 12 at one end adapted to be swung open so that dollies 14 containing racks 16, which carry the workpieces W to be coated, can be introduced into the chamber. When fully introduced into the chamber 10 and door 12 is closed, the dollies 14 make mechanical and electrical connection with devices which cause the racks to rotate slowly about their horizontal axes during the coating operation, while a high electrical current is supplied to heating coils which vaporize small slugs of aluminum or other metal to be coated onto the workpieces. The arrangement is conventional and forms no part of the present invention.

A large vacuum duct 18 connects chamber 10 to a main vacuum shut-off valve 20 located in housing 22 which connects in turn with a cryopump or Meissner coil section 24 and then with oil diffusion high vacuum pump 26. Main vacuum valve 20 is operated by a fluid motor 28 between open and closed positions to isolate vacuum chamber 10 from the diffusion pump. Multistage mechanical forepump and Roots blower 30 are connected by a duct 32 to a roughing duct 34 and a foreline duct 36. Duct 34 leads directly into chamber 10 through a roughing shut-off valve 38, while duct 36 leads into diffusion pump 26 through a foreline shut-off valve 40. Each of valves 38 and 40 is power actuated, similar to main shut-off valve 20.

The system also incorporates a Welch or auxiliary mechanical vacuum pump 42 having a vacuum intake line 44 connected into foreline duct 36 between shut-off valve 40 and diffusion pump 26. In the invention system, duct 44 is also provided with a power operated shut-off valve 46. As will be further explained, foreline valve 40 and auxiliary valve 46 are operatively connected through a controller which simultaneously opens one valve and closes the other, and vice versa, in flip/flop fashion.

In operation of the system, after articles have been racked, placed on dollies and rolled into the vacuum chamber 10, the chamber is sealed by closing door 12. At this point, main vacuum valve 20 and roughing valve 38 are closed, as is also foreline valve 40, while auxiliary valve 46 is open. All pumps are operating under idle conditions, except that auxiliary pump 42 maintains a moderately low pressure in the diffusion pump which acts to continuously purge that pump of any residual water vapor that may be present.

Figure 3:
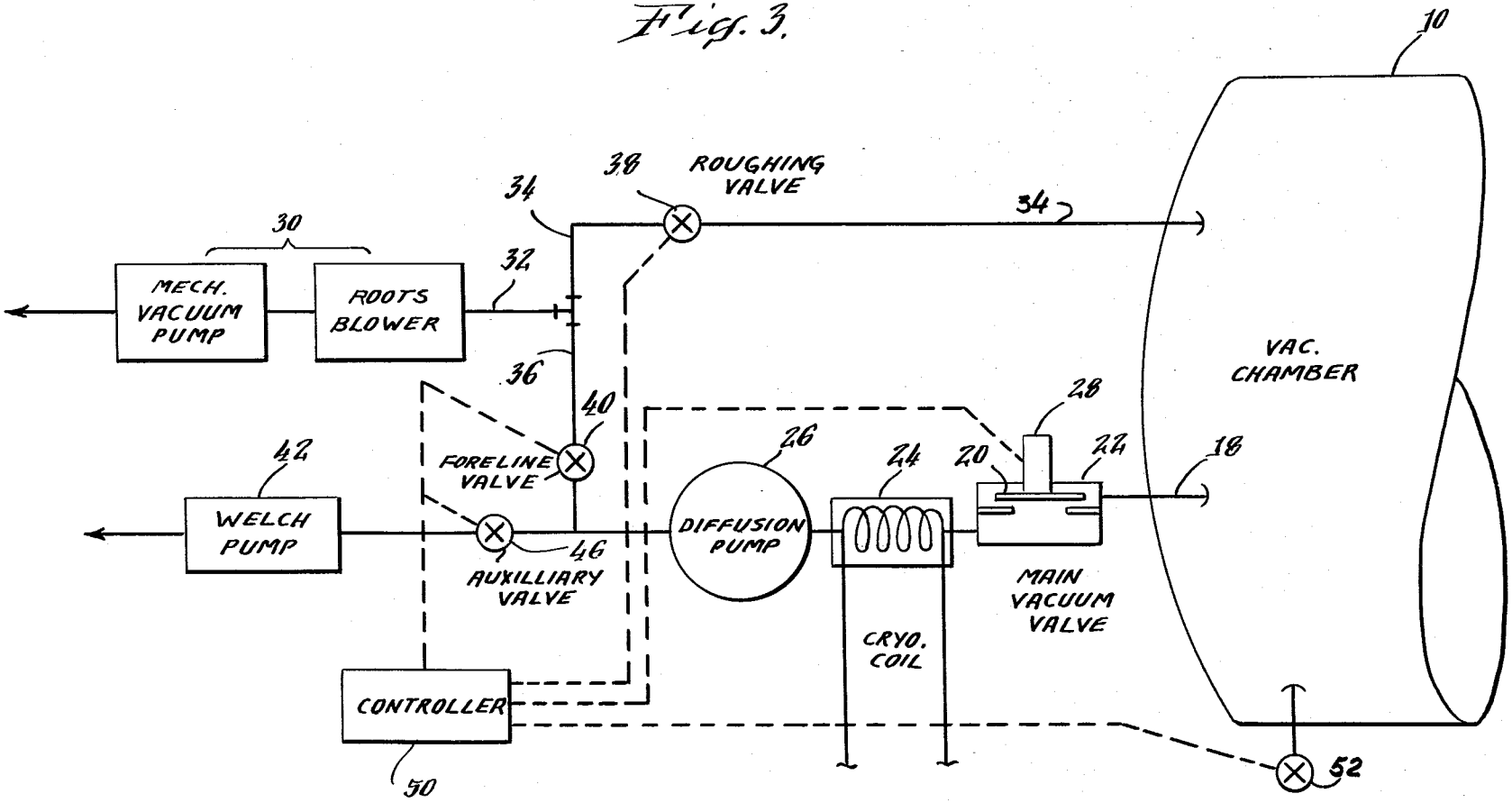
FIG. 3 is a schematic flow diagram of the vacuum pumping system shown in FIGS. 1 and 2.

Reference is made to the schematic flow diagram of FIG. 3 for visualizing the foregoing condition of the system, and of the further description of its operation which follows.

With chamber 10 loaded and closed, the vacuum draw-down operation is started by opening roughing valve 38. This places the mechanical first stage pumps 30 in direct communication with chamber 10 through ducts 32 and 34. Chamber 10 is evacuated to an intermediate level of about 200 microatmospheres, which constitutes a major portion of the work of chamber evacuation.

When this point is reached, control means represented schematically at 50 in FIG. 3, causes roughing valve 38 to close. After a short delay auxiliary valve 46 is closed and simultaneously the flip/flop arrangement of valves 40 and 46 operates to open the foreline valve 40. Controller 50 opens main vacuum valve 20, whereupon mechanical pumps 30 and diffusion pump 26 are thus connected in series flow to chamber 10 via ducts 32, 36 and 18 to chamber 10, while auxiliary pump 42 is isolated from the active vacuum pumping circuit. Because of this, backstreaming is prevented of any water vapor in pump 42 to the main vacuum pumps.

This final or "fine" pump-down phase is maintained to produce an absolute pressure of about 0.5 microatmospheres in chamber 10, and to hold that condition while the metallizing operation takes place. At the conclusion of the metallizing operation, high vacuum valve 20 is again closed isolating chamber 10 from the pumps, at which time, venting of the chamber 10 to atmosphere can begin (via a remotely controlled valve port indicated generally at 52 in FIG. 3) to allow the door to be opened and the treated workpieces to be removed and the cycle repeated with a new batch of parts. After closing of main valve 20, the flip/flop circuit is reenergized to close foreline valve 40 and open auxiliary valve 42, thus restoring the system to its initial, "idle", condition first described above.

During the foregoing idle and pump-down operations, refrigeration is supplied to cryocoil 24. Preferably the required cooling requirements of the cryocoil 24 are supplied by a cascade refrigerating system of standard commercial type such as that sold by Harris Manufacturing Co. of North Bilerica, Mass., or by Polycold Systems, Inc. mentioned above. Such a system can be employed to produce a cryocoil temperature of around minus 140°-184° F. which is sufficient to extract most of the residual water vapor present; that is, water vapor remaining after most of the atmosphere in the work chamber has been exhausted to ambient or room atmosphere. Such cascade systems, moreover, have provision for by-passing hot compressed refrigerant around the condenser directly to the cryocoil, which enables defrosting of that coil to be accomplished in a matter of minutes. This is in contrast to liquid nitrogen cold trap systems which require a number of hours to defrost. In a defrost cycle of operation, the main vacuum pumps in the invention system operate in the "idle" condition described above and are not exposed to water vapor. Only the auxiliary pump is thus exposed from vaporization of frost of the cryocoil and this is quickly exhausted to atmosphere by auxiliary pump 42. Frost that melts, or solid pieces which fall off the cryocoil, drop into the oil of the diffusion pump which is constantly heated to a temperature of approximately 425° F. This causes vaporization almost instantly, and again this is continuously exhausted to atmosphere by pump 42. Contact of water with the oil in the diffusion pump is thus very transitory so that little or no emulsification of the water and that oil takes place under the conditions obtaining. For best results, the defrost operation is maintained for an hour or two even though the water is essentially all eliminated in the first few minutes. In practice, defrosting of the system in the invention system is found necessary only about once a week, which can accordingly be scheduled on a weekend to avoid interrupting production. Such traces of water vapor which do remain in the system are collected in the sump of the auxiliary pump and while this will in time cause contamination and loss of pumping efficiency of that pump, the ordinary lubricating oil required by it is low cost and can economically be replaced as needed. Again, in practice this may be done in conjunction with the defrost cycle, at the conclusion thereof. In the interim, any water in that pump is prevented from being revaporized and backstreaming into the rest of the vacuum system by shut-off valve 46 whenever that system is in pump-down mode. Although the closing of the foreline valve isolates the auxiliary pump from the first stage roughing pumps during idle, no problem of residual water retention in them is encountered since these conventionally incorporate a gas ballast provision which prevents condensation at the operating conditions involved.

While the system will operate with various cryocoil designs commercially available, it is preferred to use a Meissner type coil of straight cylindrical configuration providing a free, open-center path through the coil in section 24 intermediate diffusion pump 26 and main shut-off valve 20.

By way of specific comparison of two systems operating for the same length of time, having the same nominal pump-down capacity and operated side-by-side on the same products, the invention system averaged about 7½ minutes for a complete processing cycle under average winter conditions, whereas the unmodified conventional system required about 15 minutes for the processing cycle. Under highly humid summer operation of the same systems, the comparable processing cycle time was again about 7½ to 9 minutes for the invention system, but the conventional system time in this case was 40 to 90 minutes per cycle. Production rate is thus from two to ten times that of the conventional system. Furthermore, replacement of pumping oil in the diffusion pump is virtually eliminated. At an average cost of about $1000 per replacement, a very significant annual savings in pump maintenance is achieved.

I claim:

1. In processing work products in a high vacuum work chamber which is repeatedly opened and closed to atmosphere in loading said products into and unloading them from said chamber, wherein there are employed in conjunction with said chamber first stage and final stage vacuum pump means, a roughing vacuum duct and a shut-off valve therein communicating said first-stage pump with said chamber, and a high vacuum duct and shut-off valve therein communicating said final stage vacuum pump with said chamber, a foreline duct and shut-off valve therein interconnecting the exhaust side of said final stage pump with the vacuum side of said first stage pump, an auxiliary pump and auxiliary vacuum duct connecting said auxiliary pump into said foreline duct between said final-stage pump and foreline shut-off valve, the method of improving the recycle rate of vacuum chamber draw-down after loading said work products into said chamber and closing same to atmosphere which comprises providing a shut-off valve in said auxiliary duct and control means operatively connecting said auxiliary duct shut-off valve with said foreline shut-off valve; and sequencing the operation of said control means to open said auxiliary duct shut-off valve and to close said foreline shut-off valve whenever said high vacuum valve is closed and said final stage vacuum pump is not evacuating said work chamber, and alternatively to close said auxiliary valve whenever said foreline and high vacuum valves are opened to evacuate said work chamber.

2. The method defined in claim 1, wherein a cryocoil is incorporated in said high vacuum duct between said final stage pump and high vacuum valve, which comprises defrosting accumulated ice on said cryocoil periodically by opening said auxiliary valve and closing said foreline and high vacuum valves, and supplying hot gas to said cryocoil while continuously running said auxiliary pump to discharge to atmosphere the water vapor produced by melting of said ice.

3. In the operation of high vacuum processing apparatus incorporating a work chamber adapted to be repeatedly opened to atmosphere for loading, processing and unloading products treated in the chamber, first stage and final stage vacuum pumps, a roughing duct and a roughing duct shut-off valve therein connecting said first stage vacuum pump to said chamber, and a high vacuum duct and a high vacuum duct shut-off valve therein connecting said final stage vacuum pump to said chamber, a foreline and foreline shut-off valve therein interconnecting the exhaust side of said final stage pump with said roughing duct between said roughing duct shut-off valve and said first stage pump, and an auxiliary vacuum pump, auxiliary duct and auxiliary duct shut-off valve therein connected to said foreline between said foreline shut-off valve and said final stage pump, the method which comprises, opening said auxiliary duct valve and closing said foreline valve whenever said high vacuum valve is closed and said final stage vacuum pump is not evacuating said work chamber, and alternatively closing said auxiliary valve when opening said foreline and high vacuum duct valves to evacuate said work chamber.

4. The method of operating the apparatus defined in claim 3, wherein said final stage vacuum pump is an oil diffusion vacuum pump.

5. The method of operating the apparatus defined in claim 4, wherein that apparatus includes a cryocoil located in said high vacuum duct between said final stage vacuum pump stage and said high vacuum shut-off valve, which method comprises periodically defrosting said cryocoil by closing said main vacuum and foreline valves and opening said auxiliary duct valve, passing hot uncondensed refrigerant through said cryocoil while operating said auxiliary pump to exhaust the melted frost to atmosphere, and closing said auxiliary duct valve again before opening said foreline and main vacuum valves to resume evacuation of said work chamber.

6. In high vacuum processing apparatus incorporating a work chamber adapted to be repeatedly opened to atmosphere for loading, processing and unloading products treated in the chamber, first stage and final stage vacuum pumps, a roughing duct and a roughing duct shut-off valve therein connecting said first stage vacuum pump to said chamber, and a high vacuum duct and a high vacuum duct shut-off valve therein connecting said final stage vacuum pump to said chamber, a foreline duct and foreline shut-off valve therein interconnecting the exhaust side of said final stage pump to said roughing duct between said roughing duct shut-off valve and said first stage pump, and an auxiliary vacuum pump and auxiliary duct connected to said foreline between said foreline shut-off valve and said final stage pump, the improvement which comprises providing a shut-off valve in said auxiliary duct and control means operatively associated with said foreline and auxiliary duct shut-off valves, said control means adapted and arranged to close one of said foreline and auxiliary valves when the other is opened, and vice versa.

7. Apparatus as defined in claim 6, which further includes a cryopump in said high vacuum duct between said final stage vacuum pump and said high vacuum duct shut-off valve.

8. Apparatus as defined in claim 7, wherein said cryopump includes provision for hot gas defrosting of its cryo surface.

9. Apparatus as defined in claim 8, wherein the cryo surface of said cryopump is a Meissner coil of substantially cylindrical configuration disposed in said high vacuum duct so as to provide a centrally open passage therethrough.

* * * * *